US009308465B2

(12) United States Patent
Cheung

(10) Patent No.: US 9,308,465 B2
(45) Date of Patent: Apr. 12, 2016

(54) TOY CONSTRUCTION KIT

(71) Applicant: Jason Cheung, Union City, CA (US)

(72) Inventor: Jason Cheung, Union City, CA (US)

(73) Assignee: Huntar Company, Union City, CA (US)

( * ) Notice: Subject to any disclaimer, the term of this patent is extended or adjusted under 35 U.S.C. 154(b) by 24 days.

(21) Appl. No.: 14/120,799

(22) Filed: Jun. 30, 2014

(65) Prior Publication Data

US 2015/0375132 A1 Dec. 31, 2015

(51) Int. Cl.
*A63H 33/08* (2006.01)
*A63H 33/06* (2006.01)

(52) U.S. Cl.
CPC ..... *A63H 33/08* (2013.01); *A63H 33/065* (2013.01)

(58) Field of Classification Search
USPC ..... 446/85, 93, 95, 106, 107, 108, 109, 118
See application file for complete search history.

(56) References Cited

U.S. PATENT DOCUMENTS 2,693,663 A * 11/1954 Burchard ..... A63H 33/04 403/346
2,710,488 A * 6/1955 Schaper ..... A63H 33/04 446/106
2,883,764 A * 4/1959 Stephens ..... G09B 25/04 220/4.28
3,605,323 A * 9/1971 Fischer ..... A63H 33/103 446/102
3,918,196 A * 11/1975 Schleich ..... A63H 33/04 428/16
5,064,399 A * 11/1991 Klitsner ..... A63H 33/08 446/118
5,199,919 A * 4/1993 Glickman ..... A63H 33/062 446/120
5,875,792 A * 3/1999 Campbell, Jr. ..... A45D 2/18 132/246
5,916,006 A * 6/1999 Ganson ..... A63H 33/00 446/107
6,220,919 B1 * 4/2001 Cheng ..... A63F 9/12 273/153 P
6,402,581 B1 * 6/2002 Podgaiz ..... A63H 33/04 403/174
8,870,185 B2 * 10/2014 Cheng ..... A63F 3/00574 273/276
8,961,257 B2 * 2/2015 Connor ..... A63H 33/065 446/107
2006/0025034 A1 * 2/2006 Slocum ..... A63H 33/065 446/119
2011/0081824 A1 * 4/2011 Heston ..... A63H 33/084 446/86

* cited by examiner

*Primary Examiner* — Kurt Fernstrom
(74) *Attorney, Agent, or Firm* — Jonathan E. Grant; Grant Patent Services

(57) ABSTRACT

A toy construction kit is disclosed. The construction kit comprising a plurality of flexible construction pieces, each of said flexible construction pieces comprising bendable rod made up of a metal wire with a plastic surrounding the metal wire. The plastic wire is flexible, said plastic surrounding said metal wire forming an elongated structure. Disks are spaced along the length of rod.

10 Claims, 10 Drawing Sheets

TOY CONSTRUCTION KIT

Over the years, there have been a number of different toy construction kits. Most involve parts which are rigid. A few toys have parts which connect the rigid parts.

The present disclosure is for a construction kit wherein the individual construction pieces are flexible. Such an arrangement allows for the pieces to be stackable. All of the rod pieces are made up of one basic groove shape that is repeated to make different lengths. When this special groove is place crosswise in another groove it stays firmly in place. Additionally, when the pieces are stacked, they can be locked together to secure the design into which the pieces are stacked.

The present disclosure will become more apparent upon reading of the following non-restrictive description thereof, given for the purpose of exemplification only, with reference to the accompanying drawings.

BRIEF DESCRIPTION OF THE FIGURES

FIG. 8G—a perspective view of the final race car using the snap and lock feature.

Figure 1:
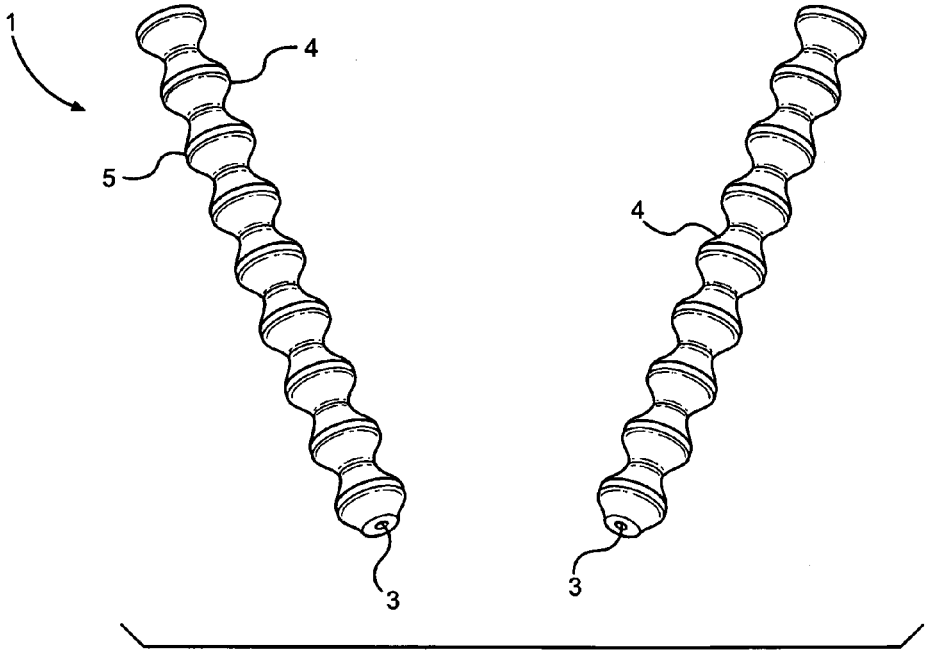
FIG. 1 is a cutaway side view of the construction piece.
Figure 2:
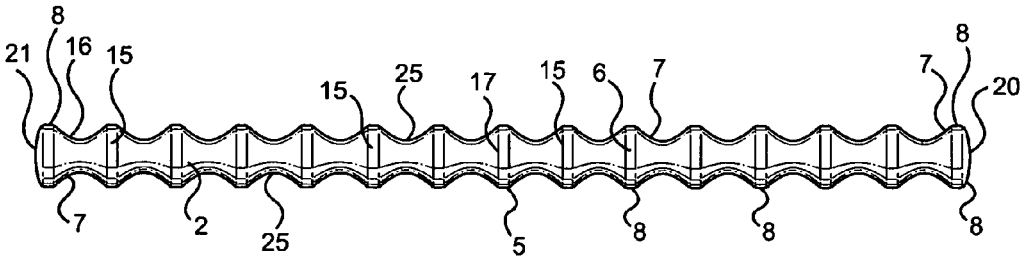
FIG. 2 is a perspective view of the construction piece.
Figure 3:
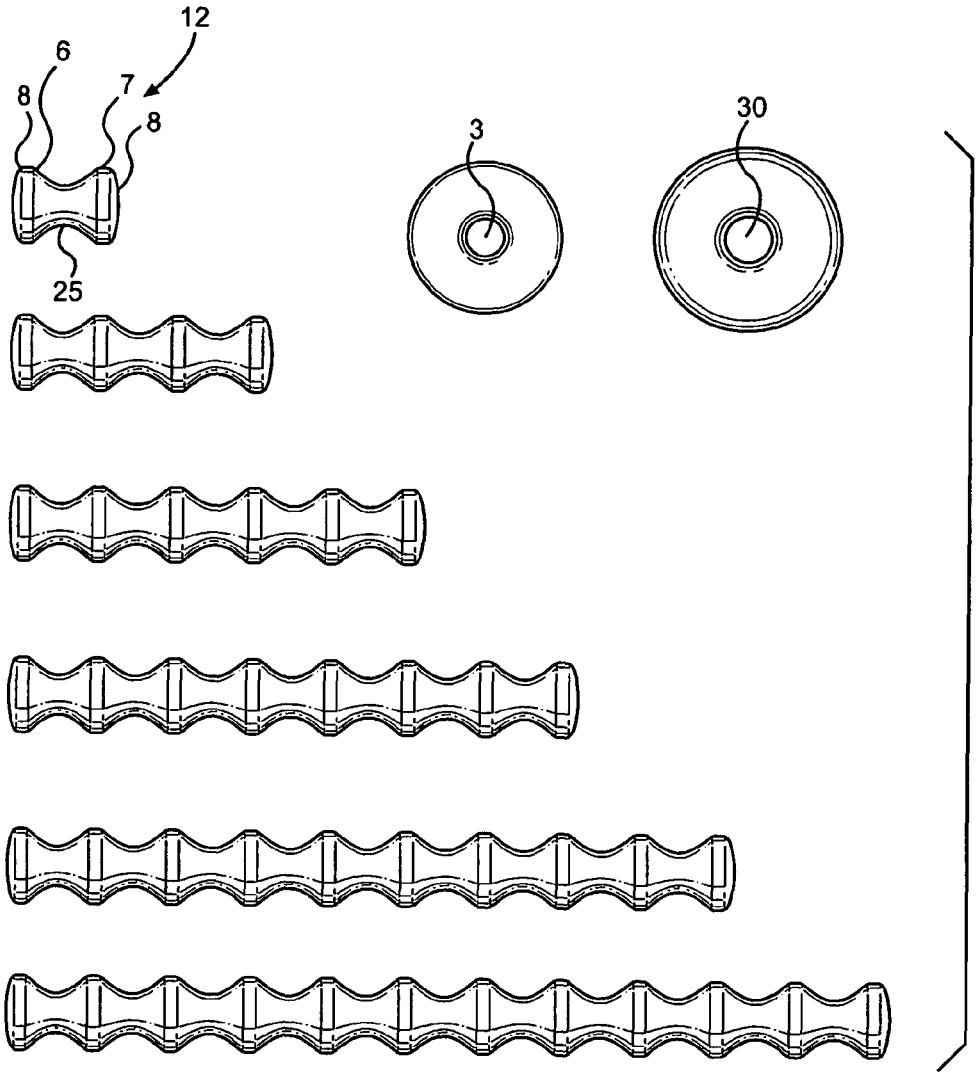
FIG. 3 is a frontal view of some of the different sizes of the construction pieces, including the wheels.
Figure 4:
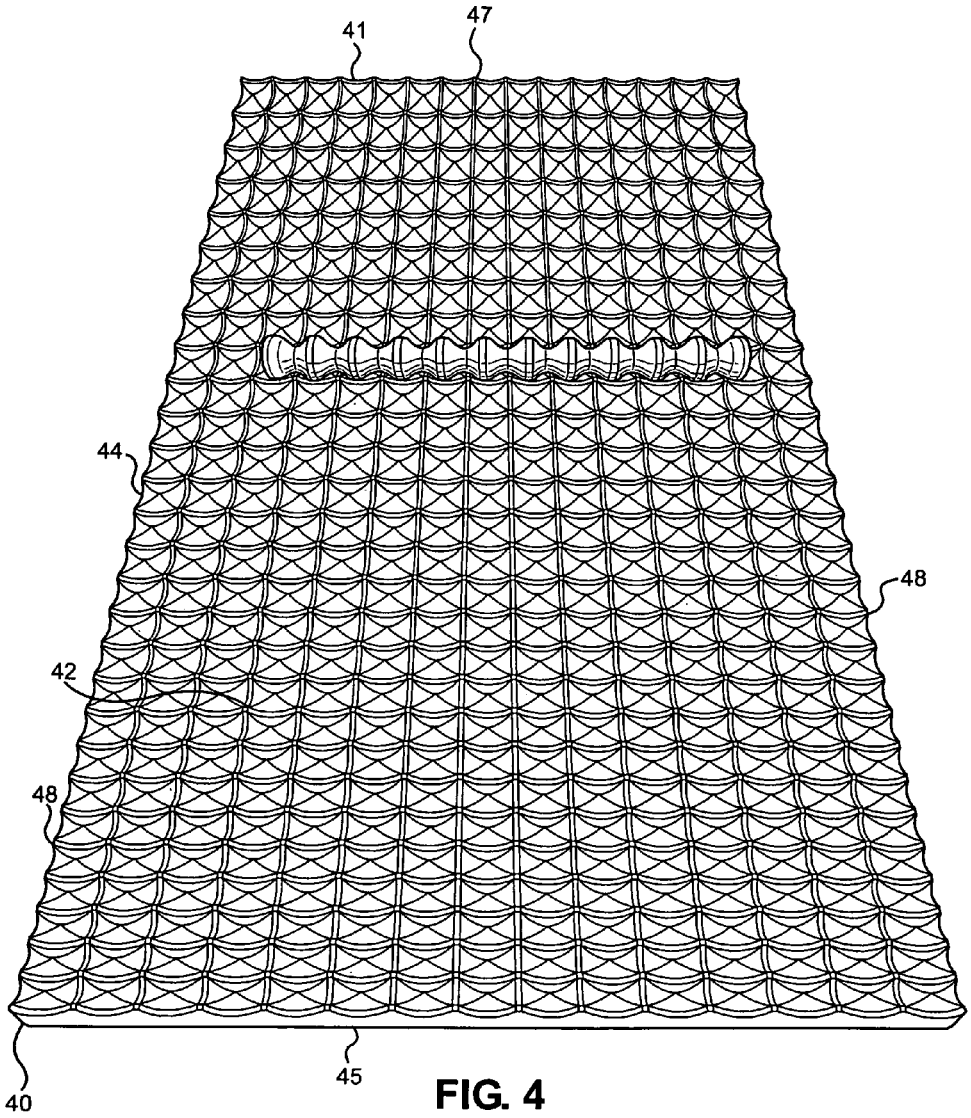
FIG. 4 is a top view of a platform.
Figure 5:
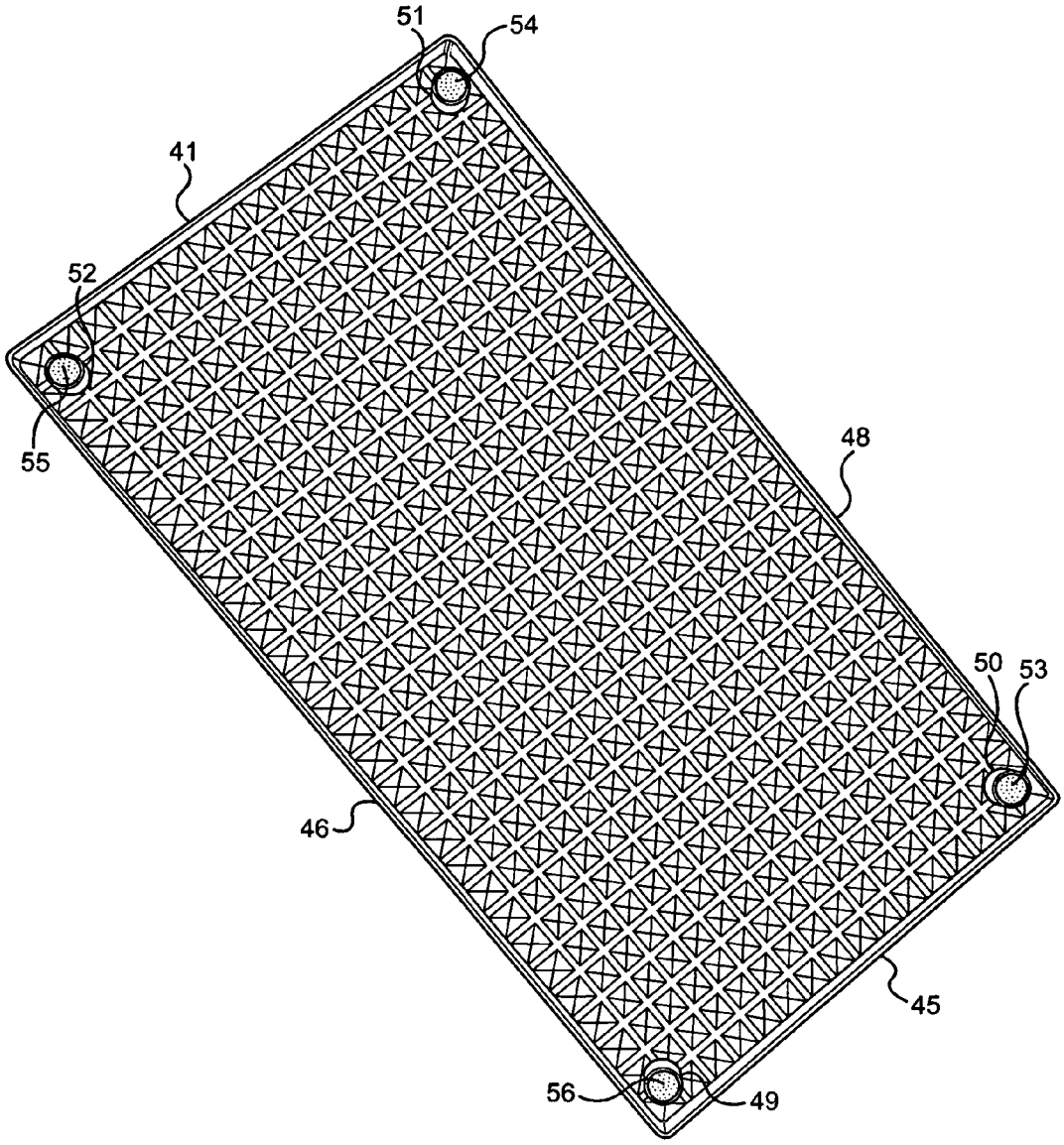
FIG. 5 is a bottom view of the platform.

The construction kit 1 includes construction rod 2. The construction rod 1 is made of a flexible wire 3 encased in plastic 4. More specifically, the center 5 of the length of the construction rod 2 is a flexible wire 3. In one embodiment, the wire 3 is made out of stainless steel. In another embodiment, the wire 3 is made out of copper. In other embodiments the wire is made out of chrome, steel, aluminum, alloys, or other metal wires. In one embodiment, the metal wire resists oxidation.

The plastic 4 is a durable plastic that accepts any plastic extrusion colorant prior to the extrusion process. Colors that are used include but are not limited to yellow, orange purple, blue, red, and green. In one embodiment, the plastic 4 is ethylene-vinyl acetate. In another embodiment, the plastic 4 is high impact polystyrene, and in yet another embodiment the plastic is acrylonitrile butadiene styrene. The plastic 4 is any durable plastic that can be bent without tearing or breaking. The wire 3 encased in the plastic allows the plastic to be bent without memory issues. The wire 3 is from about 1.0 mm to about 2.5 mm thick. In another embodiment, the wire is from about 1.0 to 2.0 mm thick, and in another embodiment, the wire is 1.5 mm thick The wire 3 runs from about half to the full length of the rod 2. In relation to the widget of the wire, the rod is from about 20 to 30 mm thick. In another embodiment, the rod is from about 25 to 30 mm thick, and in another embodiment, the rod is 28 mm thick. Fundamentally, the rod width to wire thickness is about 18:1 to 20:1. Note that the width and length of the rod can vary, and as such, the dimensions of the wire will vary in the ratios given. In an alternative embodiment, a "large" version of this toy construction kit has the same ratios, only with much larger dimensions.

The plastic rods are elongated rounded sticks, having disks 5 positioned along the length of the construction piece. Each disk 5 is comprised of 2 identically shaped conically shaped half disks 6,7, each half disk sharing a common rim 8. Each half disk 6,7, has a base 16, said base smaller than said rim. There is also a side 17 surrounding and between the circumference 18 of the rim and a circumference 19 of the base. Between the disks are grooves 25.

The disks 5 are integrally molded with the rod 2.

All of the disks 5 on a single rod 2 are of the same diameter and size, ranging from from about 110 mm to about 120 mm in diameter. In one embodiment, the disks are about 113 mm. The ratio of the disks to the rod ranges from about: 3.5:1 to about 4.5:1. In another embodiment, the ratio is 4:1. The distance between the disks ranges from 10-14 mm. In another embodiment, the distance between the disks is 11 mm.

Each end of the rods 2 terminates in a half disk 6,7, with the rim 8 of each of the half ridge 6,7 facing outward. In one embodiment, the outside ends 20, 21 of each of the half ridges 2 are rounded or slightly curved. The rods 2 are made by means of an extrusion molding process known in the industry. In one embodiment of the disclosure, there are molding holes 15 periodically in the rounded stick 9. These molding holes 15 are part of the molding process where the wire was held in place when the piece is injected with plastic.

In one embodiment, the kit comprises construction pieces of different lengths based on the number of disks 5 present. The smallest construction piece 12 has merely two half disks 6,7 the bases 8 of which face outward. Between every two disks or half disks is a groove 25. The smallest construction pieces range in length from about 37 mm to about 42 mm. The length can of the smallest piece can range from about 14.-14.4 mm. In one embodiment, the length is 14.28 mm. The larger of the construction piece 13 can have 10-15 or more disks 5.

The construction pieces 1 have flexibility along their length allowing them to be bent into a number of positions, particularly when the construction piece 13 is bent in its middle. It is easier to bend a longer construction piece 13 than it is to bend a small construction piece 13, simply because on the shorter pieces, there is a higher level of flexibility.

The number of and different lengths of the rods in the kit varies. For example, in one kit, there can be:

0->30 one groove rods
0->30 two groove roads
0->30 three groove rods
0->30 four groove rods
0->30 five groove rods
0>30 six groove rods
0->30 seven groove rods
0->30 eight groove rods
0->30 nine groove rods 0->30 ten groove rods
0->30 eleven groove rods
Etc.

In one embodiment, each sized rod is color coded to size. In one embodiment, the colors used for the rods are selected from the group consisting of baby blue, yellow, orange, red, green, royal blue and purple.

The kit also includes tires 30. The tires can be of any size. In one embodiment, there are a set of these tires 30 can range in size from 1" in diameter to 4" or more in diameter. In another embodiment, the tires are from about ¾" to 3" or more. In yet another embodiment, the tires are from about 1" to about 2" in diameter. The tires 30 are made out of a material that is selected from the group consisting of rubber, foamed rubber, and flexible plastics. In one embodiment, the tires are made out of ethylene vinyl acetate. In another embodiment, the tires are made of cardboard. The tires have a small hole 33 in the middle of the flat surface of the tire 30. from about ¼" to about ⅜" in diameter. This hole 33 stretches to fit over the first disk (or half disk) at each end of the rod 2.

The kit also comes with a mat 40. In one embodiment, the plastic is comprised of a rigid plastic, semi-rigid plastic, rubber, metal, or wood. In another embodiment, the plastic is ABS plastic. The mat can be a variety of shapes. In one embodiment, the mat 40 is rectangularly shaped. In another embodiment, the mat is square, rounded, oval, a hexagon, a pentagon, a septagon, an octagon, or any other geometric shape. In another embodiment, the mat is amorphous shaped. The surface 41 of the mat 40 is waffled. More particularly, the surface 41 comprises a plurality of rectangular wells 42 formed by a plurality of intersecting walls 42,43. The wells 42 are large enough and spaced such that the disks 5 of the rods 2 mate with a row 44 of wells 42.

In one embodiment, the surface 41 of the mat 40 has four sides 45, 46, 47, and 48. On the underside of each corner of the surface 41 are legs 49, 50, 51, and 52, which in one embodiment have rubber tips 53, 54, 55, and 56.

Figure 6A:
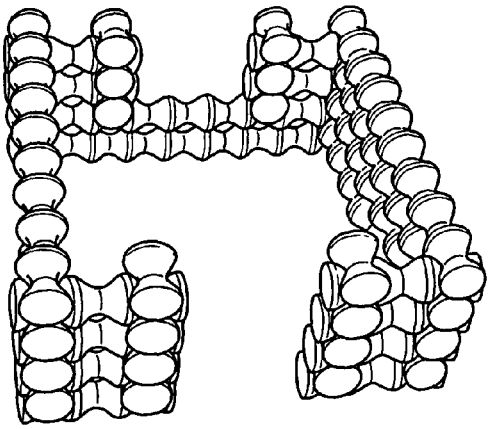
FIG. 6A is a perspective view of construction of a log cabin.
Figure 6B:
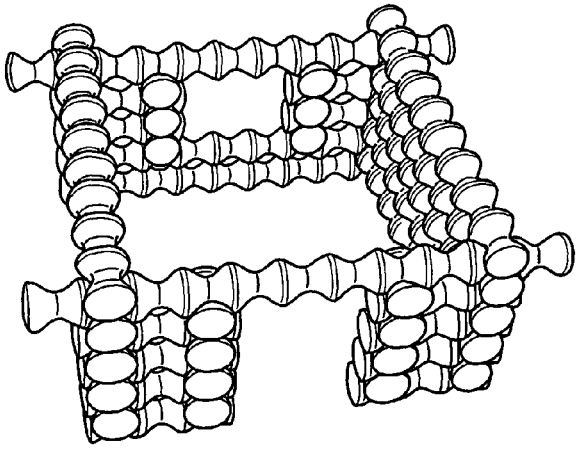
FIG. 6B is a perspective view of the addition of cross-beams of a log cabin.
Figure 6C:
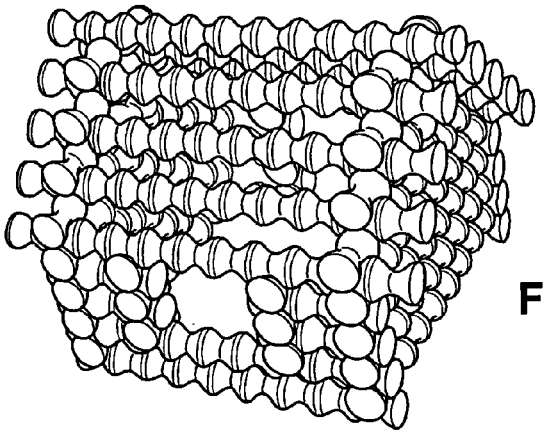
FIG. 6C is a rear perspective of a window of a completed log cabin.
Figure 6D:
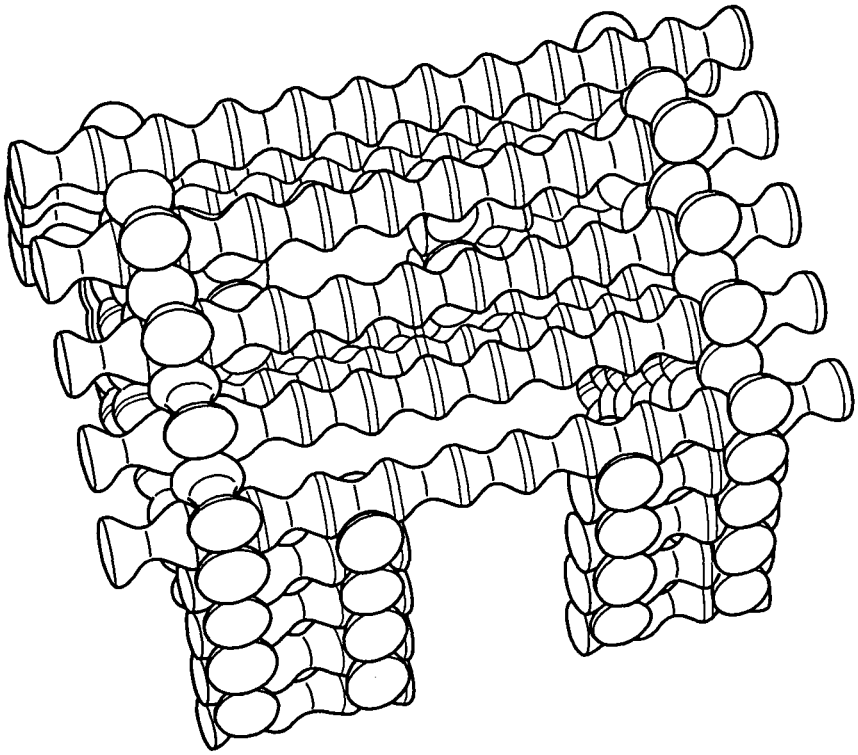
FIG. 6D is a perspective view of the front of the completed log cabin.
Figure 6E:
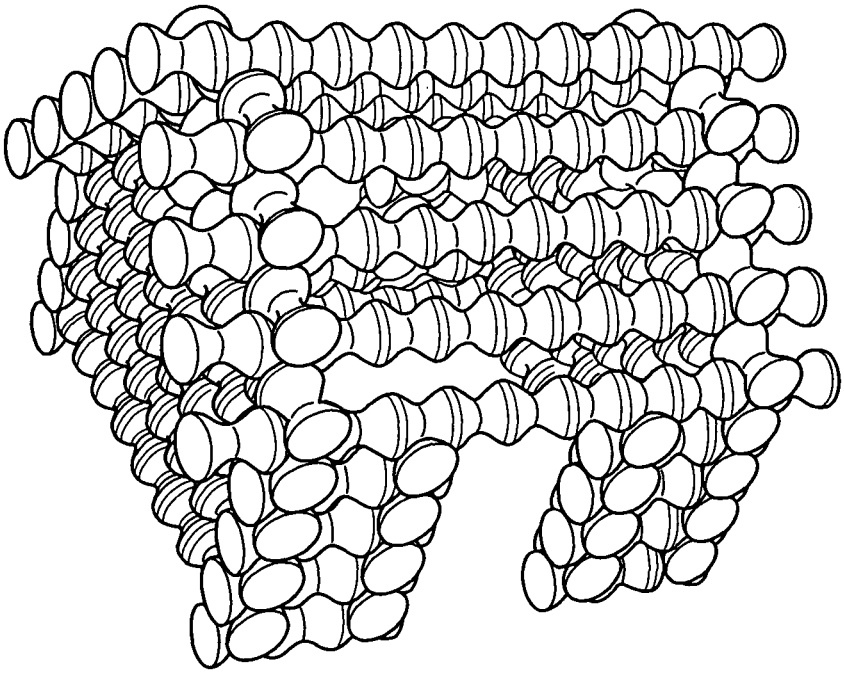
FIG. 6E is a perspective view showing the side of the completed log cabin.
Figure 7:
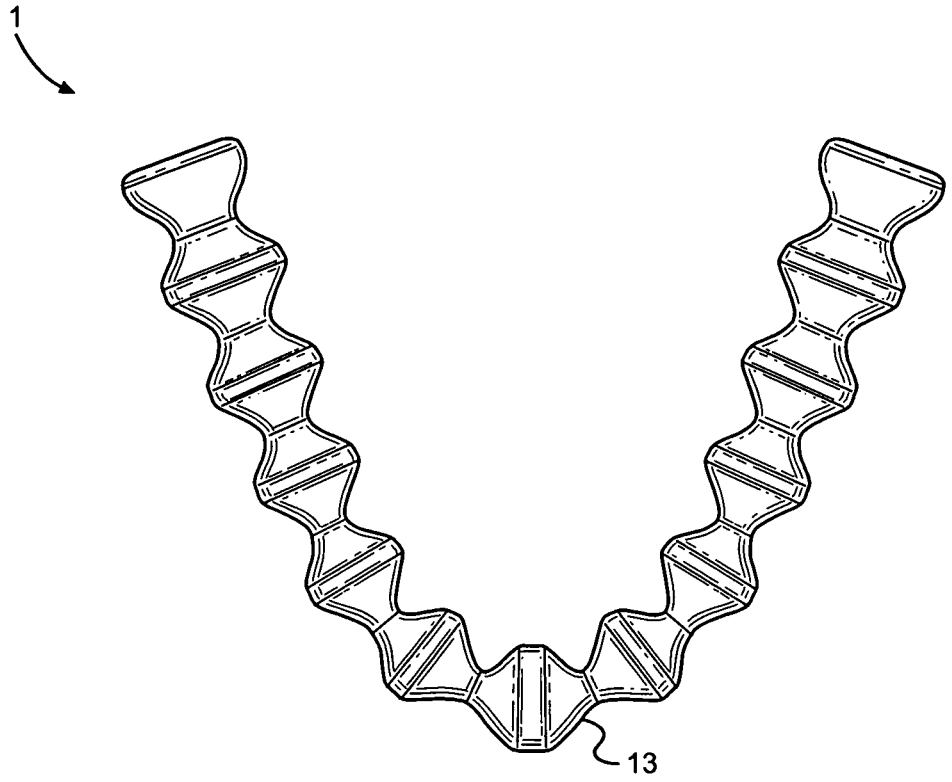
FIG. 7 is a perspective view of one of the rods that has been bent.

Shapes are built by simply stacking one rod crosswise to another. In one embodiment, stacking relies on gravity such that pieces are not necessarily locked together and can be easility taken apart. Referring to FIGS. 6*a*-6*d*, it is easy to intermix the different sized rods or construction pieces together. FIGS. 7*a*-7*e* show the construction of a "log cabin," using the intersection of different sized rods.

Figure 8A:
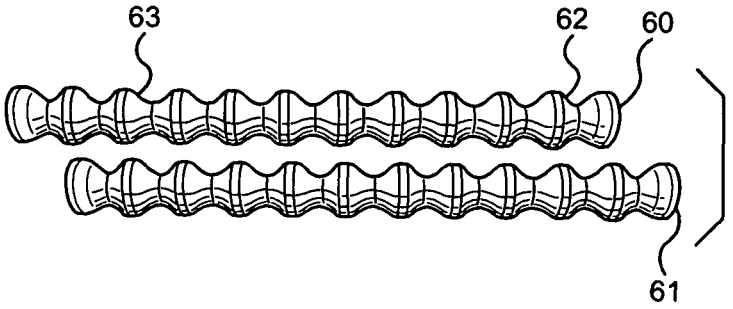
FIG. 8A—is a frontal view of the two parallel 11 disk rods for the first step of building a race car.
Figure 8B:
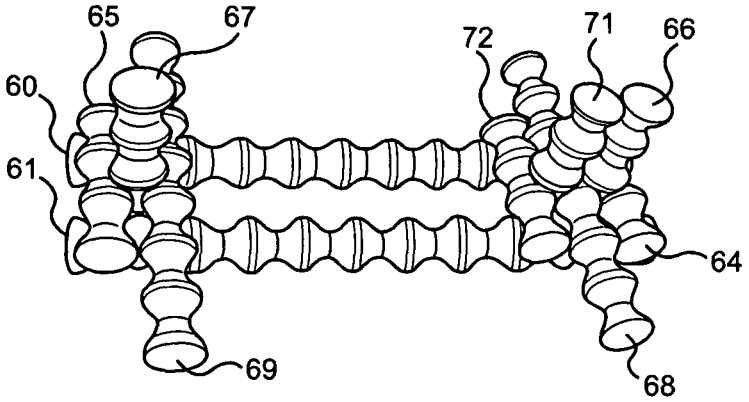
FIG. 8B—is a perspective view of the second step of building the race car.
Figure 8C:
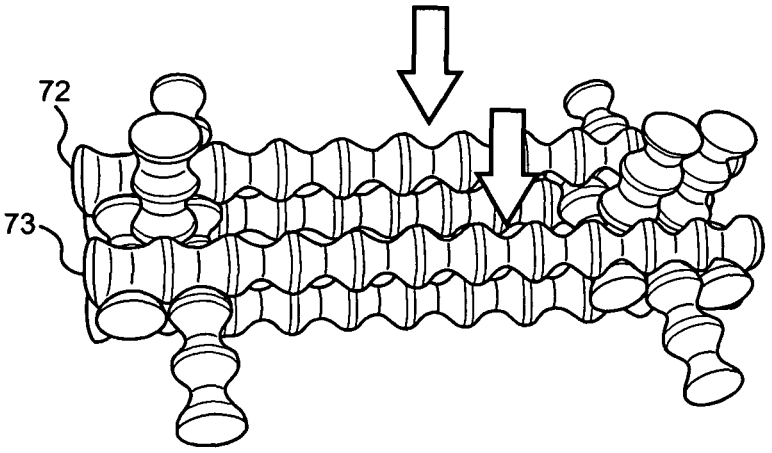
FIG. 8C—is a perspective view of the third step of the building the race car.
Figure 8D:
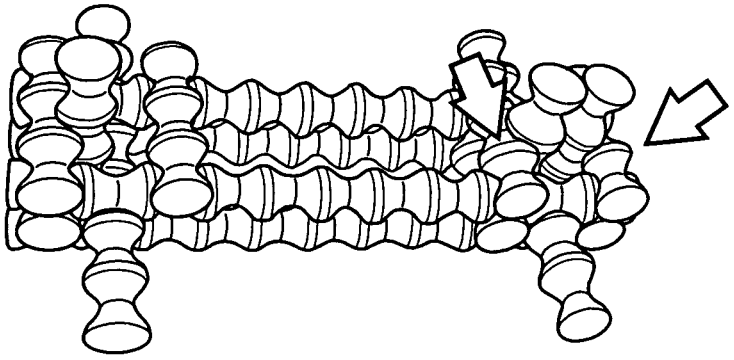
FIG. 8D—is a perspective view of the fourth step of the building the race car.
Figure 8E:
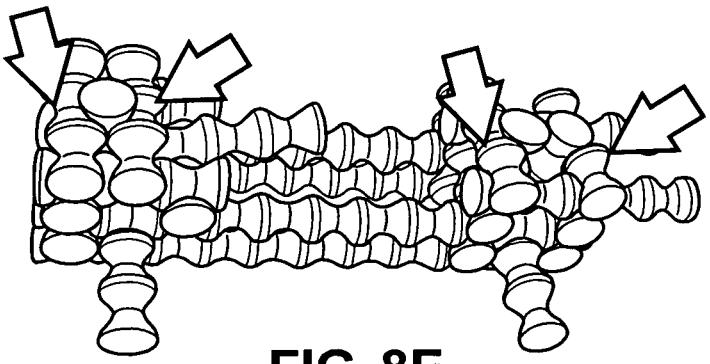
FIG. 8E—is a perspective view of the fifth step of the building the race car.
Figure 8F:
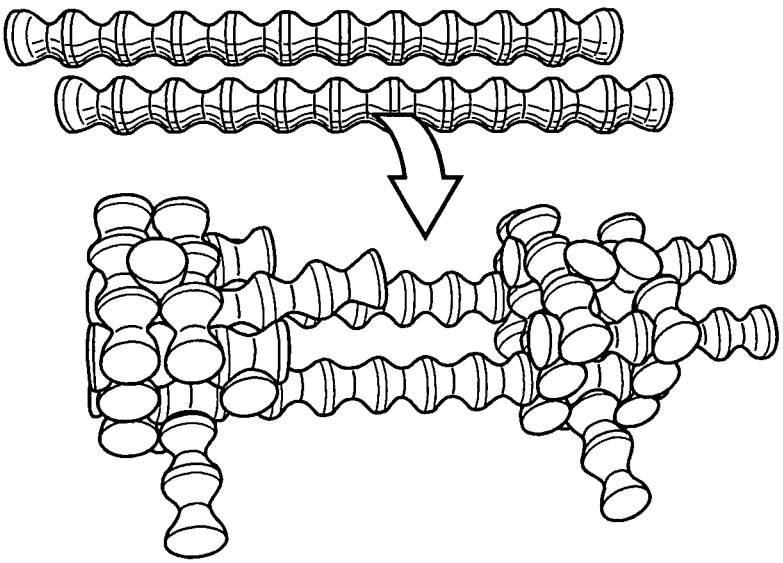
FIG. 8F—is a perspective view of the sixth step of the building the race car.
Figure 8G:
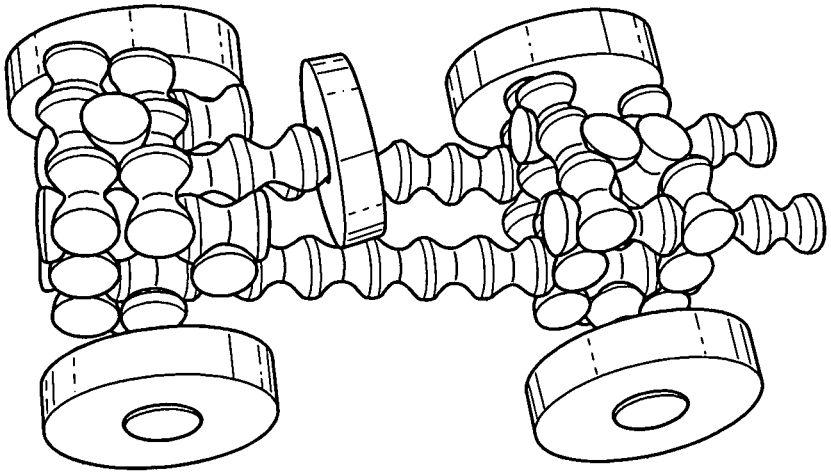

In another embodiment, the tire is fitted over and into a groove (FIG. 8).

In another embodiment of the disclosure the design of the disclosure, the kit has a snap and lock feature which locks and holds the pieces in a fixed position allowing a user to lift and play with the item that was constructed. The FIGS. 9*a*-9*f* show the steps of the construction for a race car using the snap and lock feature.

Specifically, the first step is to position two eleven groove rods 60, 61 parallel to each other. At each end 62, 63 a three groove rod 64, 65 is laid cross sectionally on top of and across the two eleven groove roads. At each end another three groove rod 66, 67 is positioned perpendicularly on the inside of the rods 64, 65. At each end, seven piece groove piece 68, 69 is positioned equilaterally in front of the perpendicular three groove rod 66, 67. At one end 62, another three groove rod 71 is positioned perpendicularly to said 7 groove rod 69 and parallel to said three groove rod. That in turn is secured in place by a three grooved part 72 in front of and parallel and in contact with seven piece groove piece 69. Next, parallel eleven groove rods 72, 73 are placed on top of an in parallel with rods 60, 61.

The rest of the drawings show the progression of how the pieces are secured together.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

I claim:

1. A toy construction kit, said toy construction kit comprising a plurality of flexible construction pieces, each of said flexible construction pieces comprising:

a) a bendable rod, said comprising:
  i) a metal wire;
  ii) a plastic, said plastic surrounding said metal wire, said plastic being flexible, said plastic surrounding said metal wire forming an elongated structure, said plastic extruded around said metal wire and forming:
    I) at least two half disks integral with and positioned perpendicularly to said bendable rod, said each of said half disks comprising:
      A) a rim,
      B) a base, said base smaller than said rim: and
      C) a side surrounding and between the circumference of the rim and a circumference of the base;

said one said half disk being positioned at each end of said rod, said rim of each said half disk facing outward from said rod, said rod and said half disks being integrally molded, said plurality of flexible construction pieces including said construction pieces of varing lengths, further including a plurality of rods of different lengths, said plurality of rods comprising:

iii) at least one disk, said disk comprised of two said half disks, each said half disk positioned perpendicularly to an axis of said rod, wherein said two half disks are integrally molded together at their rim, said disk positioned between said half disks at each end of the rod, said disks being integrally molded as part of the rod;

a) a plurality of said disks positioned between said half disks at each end of the rod, said disks being the same equidistance from each other and from the half disks, such that the number of disks on said rod are dependent on a length of said rod;

wherein said flexible construction pieces interlock with other said flexible construction pieces.

2. The toy construction kit of claim 1, a metal of said metal wire is selected from the group consisting of copper, stainless steel, steel, aluminum, and alloys.

3. The toy construction kit of claim 2, said metal wire consisting of stainless steel.

4. The toy construction kit of claim 1, where said metal is oxidation resistant.

5. The construction kit of claim 1, wherein said plastic surrounding said metal wire is durable plastic that accepts any plastic extrusion colorant prior to the extrusion process.

6. The construction kit of claim 5, wherein said plastic is selected from the group consisting of ethylene-vinyl acetate, high impact polystyrene, and acrylonitrile butadiene styrene.

7. The construction kit of claim 1, wherein said rods of different lengths are color coded.

8. The construction kit of claim 1, further comprising tires, said tires comprising a slit or hole in the middle, said tires having the ability to fit over said half disk at each end of said rod.

9. The construction kit of claim 1, further comprising a platform base.

10. The construction kit of claim 9, wherein said platform base has a waffled grid surface.

* * * * *